US009366051B1

(12) United States Patent
Wojtowicz et al.

(10) Patent No.: US 9,366,051 B1
(45) Date of Patent: Jun. 14, 2016

(54) IMPACT SAND ANCHOR

(71) Applicants: Edward A Wojtowicz, Bryn Mawr, PA (US); Paul M Wojtowicz, Mt. Laurel, NJ (US)

(72) Inventors: Edward A Wojtowicz, Bryn Mawr, PA (US); Paul M Wojtowicz, Mt. Laurel, NJ (US)

( * ) Notice: Subject to any disclaimer, the term of this patent is extended or adjusted under 35 U.S.C. 154(b) by 0 days.

(21) Appl. No.: 14/521,177

(22) Filed: Oct. 22, 2014

Related U.S. Application Data

(60) Provisional application No. 61/894,777, filed on Oct. 23, 2013.

(51) Int. Cl.

| | |
|---|---|
| ***E04H 12/22*** | (2006.01) |
| ***A45B 25/00*** | (2006.01) |
| ***E04H 12/18*** | (2006.01) |
| ***A45B 23/00*** | (2006.01) |

(52) U.S. Cl.
CPC ..... *E04H 12/22* (2013.01); *A45B 23/00* (2013.01); *A45B 25/00* (2013.01); *E04H 12/185* (2013.01); *E04H 12/2269* (2013.01); *A45B 2023/0012* (2013.01); *A45B 2025/003* (2013.01)

(58) Field of Classification Search
CPC ..... E04H 12/223; E04H 15/62; E02D 5/805; A45B 2023/0012; A01K 97/10; A45F 3/44
USPC ..... 135/15.1; 52/155; 248/156, 530
See application file for complete search history.

(56) References Cited

U.S. PATENT DOCUMENTS

| | | | | |
|---|---|---|---|---|
| 1,153,380 | A * | 9/1915 | Fussell | 52/155 |
| 1,263,132 | A * | 4/1918 | Sharpe | 52/155 |
| 1,408,007 | A * | 2/1922 | Klein | 52/158 |
| 1,582,454 | A * | 4/1926 | Evans | 52/155 |
| 2,580,948 | A * | 1/1952 | Pancake | 40/607.08 |
| 5,301,481 | A * | 4/1994 | Novak | 52/165 |
| 5,765,321 | A * | 6/1998 | Barbera | 52/155 |
| 6,267,127 | B1 * | 7/2001 | Doreste | 135/15.1 |
| 6,328,046 | B2 | 12/2001 | Doreste | |
| 7,520,485 | B1 | 4/2009 | Giannetto | |
| 8,136,291 | B2 * | 3/2012 | Morgan | 47/47 |
| 2006/0236620 | A1 * | 10/2006 | LaCrosse | 52/155 |

FOREIGN PATENT DOCUMENTS

| | | | | |
|---|---|---|---|---|
| CA | 2227021 | A1 * | 9/1999 | |
| GB | 29408 | * | 0/1914 | E04H 12/22 |

(Continued)

OTHER PUBLICATIONS amazon.com, "Beach Umbrella Anchor—Sand Anchor Easily Twists in to Secure Umbrella—265 Inches (Colors May Vary)" accessed Oct. 22, 2014.

(Continued)

*Primary Examiner* — Noah Chandler Hawk
(74) *Attorney, Agent, or Firm* — Robert J. Yarbrough; Lipton, Weinberger & Husick

(57) ABSTRACT

An impact sand anchor features a body and a plurality of cantilever beams. The cantilever beams define an interior volume between the cantilever beams. The cantilever beams are generally parallel to a longitudinal axis of the impact sand anchor in a first position. When the cantilever beams are driven into the sand, as by a trapped cylindrical hammer, the force of sand packed into the interior volume causes the cantilever beams to move radially away from the longitudinal axis to a second position. The movement of the cantilever beams to the second position wedges the impact sand anchor into the sand.

10 Claims, 12 Drawing Sheets

(56) References Cited

FOREIGN PATENT DOCUMENTS

| | | | | | |
|---|---|---|---|---|---|
| GB | 2042019 | A | * | 9/1980 | ..... E04H 17/22 |
| GB | 2132659 | A | * | 7/1984 | ..... E02D 5/80 |

OTHER PUBLICATIONS amazon.com, "Seasonal Industries, Inc.—Plastic Umbrella Anchor—1 Unit (Color: Blue or Green)" accessed Oct. 22, 2014.
amazon.com, "ShelterLogic 15: Augur Anchor 40' Rope, 4 Pieces" accessed Oct. 22, 2014.
amazon.com "Dig-Git DG-00030 Umbrella Anchor/Shovel" accessed Oct. 22, 2014.
amazon.com, "Guyline Sand Anchor Plates" accessed Oct. 22, 2014.
amazon.com "Outdoor beach umbrella stand—Great Sand Anchor . . . " accessed Oct. 22, 2014.
Rio Brands, "Sand Anchor" accessed Oct. 22, 2014.
amazon.com "Sand Grabber for Umbrellas" accessed Oct. 22, 2014.

* cited by examiner

IMPACT SAND ANCHOR

I. STATEMENT OF RELATED APPLICATIONS

This utility patent application for an impact sand anchor is entitled to priority from provisional application 61/894,777 by Edward Wojtowicz filed Oct. 23, 2013. Application 61/894,777 is incorporated by reference as if set forth in full herein.

II. BACKGROUND OF THE INVENTION

A. Field of the Invention

The impact sand anchor of the invention provides an anchor location in sand. As used in this document, the term 'sand' means beach sand and also means any other suitable soil or granular material into which the sand anchor may be driven. The sand anchor may support a beach umbrella, fishing rods, nets for game play or any other desired object on the sand. The impact sand anchor allows attachment of the beach umbrella or other object quickly and with little effort, making the impact sand anchor suitable for use by persons having limited strength. The impact sand anchor may be integral to a beach umbrella or other object to be supported. Alternatively, the impact sand anchor may be stand-alone. The Invention also relates to a method for supporting a beach umbrella using the impact sand anchor and a kit of parts including the impact sand anchor and a beach umbrella.

B. Statement of the Related Art

The simplest apparatus to support an umbrella on a beach or in other sandy soil is the bare pole of the umbrella. A user inserts the end of the bare pole in the sand to a suitable depth, say, 12 inches. The mass of the sand into which the bare pole is inserted and the friction force of the sand grains against one another resist blow-over of the bare pole and hence the umbrella. The friction force of the sand grains against the bare pole resists pull-out of the pole. As used in this document, the term 'blow-over' or 'pull over' refers to a force applied to a pole or umbrella generally parallel to the surface of the ground, as by a wind blowing normal to the longitudinal axis of the pole supporting the umbrella. As used in this document, the term 'pull out' refers to a force applied along the longitudinal axis of the pole in a direction away from the ground.

In a typical wind situation on a beach, a wind blows parallel to the surface of the ground and pushes upon an umbrella canopy supported by a bare umbrella pole. The umbrella pole is oriented initially so that its longitudinal axis is generally normal to the surface of the ground and to the wind. The force of the wind acting on the umbrella causes the umbrella pole to displace the sand into which the umbrella pole is buried, allowing the umbrella to tilt. As the umbrella pole tilts away from the wind, a component of the force applied by the wind to the umbrella canopy becomes a pull-out force along the longitudinal axis of the umbrella pole. For the same wind speed, the greater the tilt of the umbrella, the greater the pull-out force applied by the wind to the umbrella pole.

The resistance to pull-out of a partially buried bare pole is provided only by the friction of the sand grains against the buried shaft of the pole, and hence a bare umbrella pole offers little pull-out resistance. If the wind is successful in pulling the umbrella from the sand, the umbrella and its pole may tumble downwind, creating a hazard to the user and to others.

Sand anchors are known in the art. A prior art plate-type sand anchor may consist of plates, boards or logs buried in the sand and to which a guy line is attached. The plate-type sand anchor may support a tube, such as a tube to receive the end of an umbrella pole. The plate, boards or log must be buried in a hole that is large enough to receive the plate, board or log and deep enough so that the weight of sand on the top of the plate, board or log will adequately apply tension to the guy line or will adequately support the tube. The user must manually dig and fill the hole, which may not be possible for persons having limited strength or endurance.

A tapered thread-type sand anchor includes a tapered shaft having a threaded portion. The user turns the shaft to turn the threaded portion of the tapered thread-type sand anchor, engaging the threads with the sand to pull the sand anchor into the sand. Turning a tapered thread-type sand anchor can require considerable strength and work, placing use of such anchors out-of-reach by persons having limited strength or limited endurance. Rather than turning the shaft, many users may dig a hole in the sand and manually bury the threaded portion of the tapered thread-type sand anchor.

An auger-type sand anchor provides a propeller shape on the end of a tubular shaft. As for the tapered thread-type sand anchor, the user turns the tubular shaft and the propeller shape pulls the auger-type sand anchor into the sand. As for the tapered thread-type anchor, turning a auger-type sand anchor can require considerable strength and work, placing use of such anchors out-of-reach by persons having limited strength or limited endurance. Many users may dig a hole and manually bury auger-type sand anchors rather than attempt to install the anchor by turning the shaft.

An angled tube-type of sand anchor provides a thick-walled cylindrical plastic tube that is driven into the sand. The bottom end of the tube slopes from one side of the tube to the other, so that one side of the tube extends further in the downward direction than the other and providing a relatively sharp point on one side of the tube. In use, the sharp point is driven into the sand using a hammer. During installation, the hollow tube becomes plugged with sand, forming an asymmetrical wedge that forces the sand anchor laterally in response to hammer blows, reducing the contact of the angled tube with the sand and reducing its resistance to pull-out and pull-over. Removing sand packed into the end of the tube also can be a challenge and may require multiple hammer blows.

The prior art does not teach the sand anchor of the Invention.

III. BRIEF DESCRIPTION OF THE INVENTION

In overview, the impact sand anchor of the Invention features a plurality of cantilever beams that define an interior volume between the cantilever beams. When the impact sand anchor is driven into the sand, sand packs into the interior volume and forces the cantilever beams to pivot radially from a first position to a second position to engage the sand, securing the impact sand anchor.

The impact sand anchor of the Invention has an anchor top end, an anchor bottom end and an anchor longitudinal axis extending between the top and bottom ends. The bottom end of the impact sand anchor is defined by the plurality of elongated cantilever beams. Each cantilever beam has a cantilever top end and a cantilever bottom end. The cantilever top end of each cantilever beam is defined by a pivot location and each of the pivot locations is attached to each of the other pivot locations. The cantilever bottom end of each cantilever beam can elastically rotate about the pivot location between a first position and a second position. In the first position, corresponding to when the impact sand anchor is not in engagement with sand, the cantilever beams are generally parallel. In the second position, corresponding to when the impact sand anchor is anchored to the sand, each of the bottom cantilever ends is displaced outward radially with respect to the longitudinal axis of the impact sand anchor. In the second position, the cantilever beams are less parallel than when the cantilever beams are in the first position.

The plurality of cantilever beams in combination define an interior volume disposed generally along the anchor longitudinal axis proximal to the anchor bottom end. When the anchor bottom end is driven into the sand, sand is packed into the interior volume and exerts force on the interior side of the cantilever beams. The force exerted by the sand causes each cantilever beam to pivot about the pivot locations to the cantilever second position. The spreading of the cantilever beams to the second position applies force to the sand adjacent to the outer side of the cantilever beams, wedging the cantilever beam in place in the sand.

The allowable radial deflection of the cantilever beams in moving from the first to the second position is limited. Plastic deformation of the cantilever beams resulting from excess deformation at the pivot locations could result in failure of the beams. To prevent excess deformation, a limiter in the form of a ring may be attached, as by welding, to the outer side of one of the cantilever beams and may circle the outer sides of the remaining cantilever beams. The ring is sized to allow the cantilever beams to move between the first and second positions, but to prevent movement of the cantilever beams beyond the second position. Alternatively the cantilever beams may be attached one to the other by a flexible cable on either the inner side or the outer side of the cantilever beams that allows the cantilever beams to move between the first and second positions, but that does not allow over-extension and hence plastic deformation of the pivot locations.

The ring, or, alternatively, the flexible cable, may serve to act as a guide to limit the insertion depth to which the cantilever beams may be driven into the sand. The ring may encircle the cantilever beams at a distance from the bottom end of the sand anchor corresponding to the optimal insertions depth and may contact the sand when the optimal insertion depth is reached, providing a visual cue to the user. In addition, the effort required to drive the sand anchor into the sand beyond the depth of the ring is increased due to the resistance to motion of the ring through the sand, providing an effort cue to the user. The flexible cable, disposed on either the inner side or the outer side of the cantilever beams, may provide the same cues to the user.

The cantilever beams may be of any suitable shape and composed of any suitable material. A shape that has proven suitable in practice is to create the cantilever beams so that the cantilever beams are arcuate in cross section normal to the longitudinal axis of the impact sand anchor. The arcuate shape stiffens the cantilever beams against flexion along their length and allows a smaller cross sectional area than would be the case if the cantilever beams did not have a cross section promoting stiffness in flexion.

Steel has proven to be a suitable material from which to form the cantilever beams. In practice, forming the cantilever beams and the anchor body by cutting a single steel tube has proven successful. Two or more cantilever beams may be created by cutting two or more slots in the steel tube from the bottom end of the steel tube. The curve of the walls of the steel tube define the arcuate cross section of the cantilever beams. The interior of the steel tube inside the cantilever beams thus created defines the inner sides of the cantilever beams and the interior volume of the impact sand anchor, into which sand is packed when the anchor is driven into the sand.

The ends of the slots distal to the bottom end of the steel tube may be manipulated to define the pivot locations, as by terminating each slot with a circular or oblong opening, or with a hole of any suitable shape. The pivot locations effectively are flat springs urging the cantilever beams to the first position. The circular or oblong openings are selected to adjust the spring rate of the flat springs. The use of smoothly curved openings, such as circular or oblong openings, reduces stress risers in the steel tube in the vicinity of the pivot location, extending the life of the impact sand anchor.

The impact sand anchor may include a cylindrical hammer to drive the impact sand anchor into the sand. Where the impact sand anchor is integral with a beach umbrella, the cylindrical hammer may slide on the umbrella shaft. The bottom end of the travel of the cylindrical hammer is defined by a lower stop, which may be the steel tube that defines the cantilever beams. The top end of the travel of the cylindrical hammer also may be defined by an upper stop. The upper stop may be any mechanism to limit the travel of the cylindrical hammer, such as a screw or pin penetrating the shaft on which the cylindrical hammer travels. Alternatively, the cylindrical hammer may be attached to the steel tube by a cable or cord, the cable or cord being selected to have a length adequate to allow the user to use the hammer to strike the lower stop but not long enough to allow the cylindrical hammer to escape the shaft on which it can move.

The cylindrical hammer may include a guard to prevent finger or hand pinches between the cylindrical hammer and the lower stop. The guard comprises a resilient member that encloses the bottom end of the cylindrical hammer. The guard extends beyond the cylindrical hammer in close proximity to the lower stop. If the user inadvertently places the user's hand in the vicinity of the lower stop where the user's finger or hand can be pinched by the cylindrical hammer, the resilient member will push the user's hand out of the way, avoiding injury.

The portion of the resilient guard that may strike the hand of the user may be in the shape of a torroid having a generally triangular cross section or the like so that when the resilient guard strikes the user's hand, a small cross-section of the resilient material first strikes the user's hand, followed by increasing cross-sectional areas of the resilient material. The cylindrical hammer is thus progressively decelerated (or the hand is progressively accelerated out of the way) without a sudden impact of all of the momentum of the cylindrical hammer on the hand of the user.

The resilient member also can serve as a hand grip for a person using the hammer to drive the impact sand anchor into the sand. If the hand grip allows the user to maintain his or her grip of the cylindrical hammer at the end of a stroke, the momentum of the user's moving arm is transmitted through the grip to the hammer, providing more force to drive the impact sand anchor into the sand. A resilient hand grip that allows the user to continue gripping the hammer at the end of the stroke allows use of a smaller and lighter hammer than would otherwise be the case.

An integrated guard and grip in the shape of a sphere; namely, a rubber ball, has proved suitable in practice. The sphere defines a cylindrical hole penetrating the sphere and sized to accommodate the cylindrical hammer and the lower stop. The sphere is bonded to the cylindrical hammer and extends beyond the bottom end of the cylindrical hammer.

The impact of the cylindrical hammer on the lower stop will make noise, even though that noise is suppressed somewhat by the resilient guard overlapping the bottom end of the cylindrical hammer and the lower stop. The noise may be further attenuated by a seal. The seal may be mounted to the anchor body immediately below the lower stop. As the cylindrical hammer approaches the lower stop and just before impact, the inside of the portion of the guard that overlaps the cylindrical hammer comes in contact with the seal, forming a barrier to the air transmission of sound from impact between the cylindrical hammer and the lower stop.

Because of the upwardly-sloping inner sides of the cantilever beams in the second position, removal of the sand packed into the body of the impact sand anchor is remarkably easy—a few tap of the cylindrical hammer on the body dislodges the sand. The impact sand anchor provides an auditory cue that the sand is removed—the pitch of the sound of the impact of the cylindrical hammer changes, signaling that the sand is no longer in place.

The impact sand anchor may be stand-alone and may be installed independently of an object to be supported by the impact sand anchor. In such event, the impact sand anchor of the Invention will be configured to support the object, as by providing a tube attached to the cantilever beams and sized to accept the shaft of a beach umbrella or other object, such as a post to support a net for a sporting contest. Any use to which a beach anchor may be put is contemplated by the invention.

The impact sand anchor may be integral to a beach umbrella, with the shaft of the beach umbrella either permanently or releasably attached to the cantilever beams and cylindrical hammer. If the beach umbrella is attached by a pin connection to the impact sand anchor of the Invention, the pin will be trapped by a slot that extends parallel to the anchor longitudinal axis so that the impact sand anchor may be accelerated downward independently of the beach umbrella (by striking the lower stop with the cylindrical hammer) without also accelerating the mass of the beach umbrella. The use of the slot allowing independent downward acceleration of the impact sand anchor allows the impact sand anchor to be installed to sand while also attached to the beach umbrella.

The impact sand anchor may be included in a kit comprising a beach umbrella and a impact sand anchor, where the beach umbrella is attachable to the impact sand anchor.

The impact sand anchor may be utilized in a method of supporting a beach umbrella.

IV. BRIEF DESCRIPTION OF THE DRAWINGS

V. DESCRIPTION OF AN EMBODIMENT

The Invention is a sand anchor, a umbrella integrated with a sand anchor, a kit including the sand anchor and a beach umbrella, and a method of supporting a beach umbrella using the sand anchor.

Figure 1:
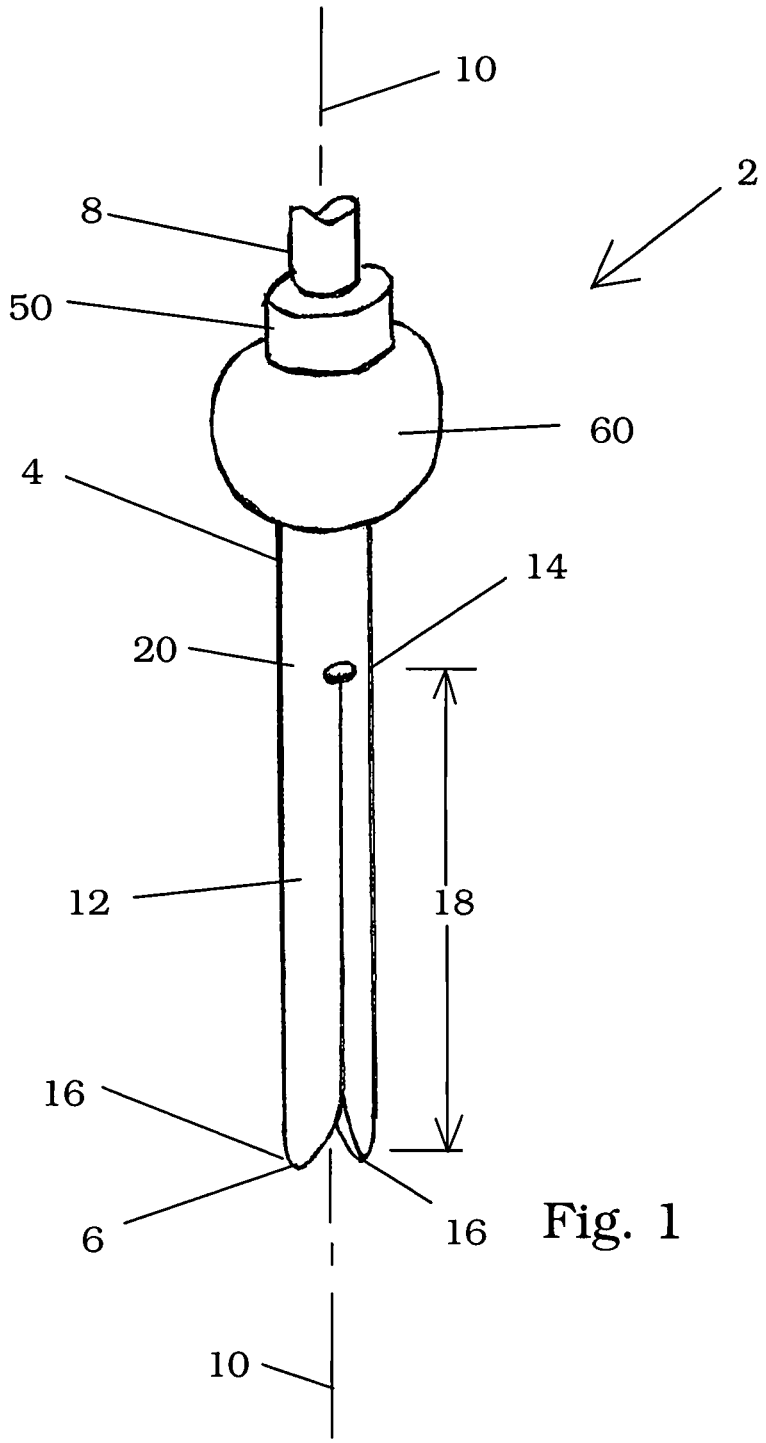
FIG. 1 is a perspective view of the impact sand anchor.
Figure 2:
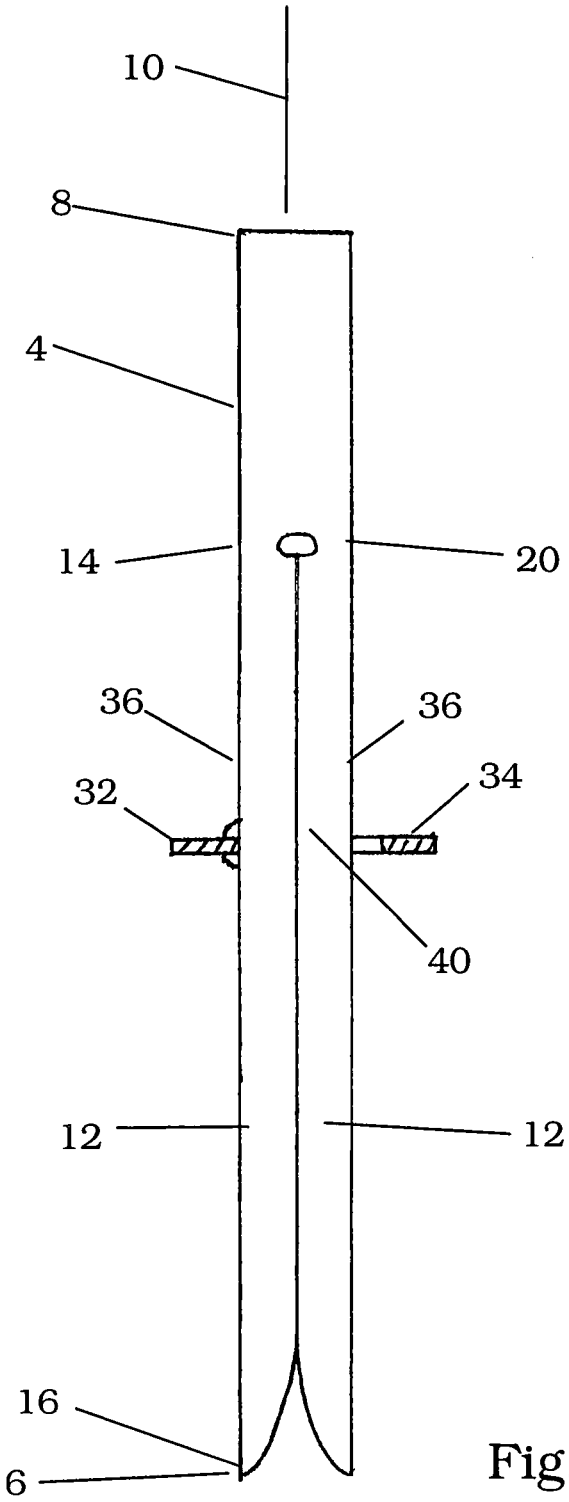
FIG. 2 is a side view of the anchor body and cantilever beams in the first position.
Figure 3:
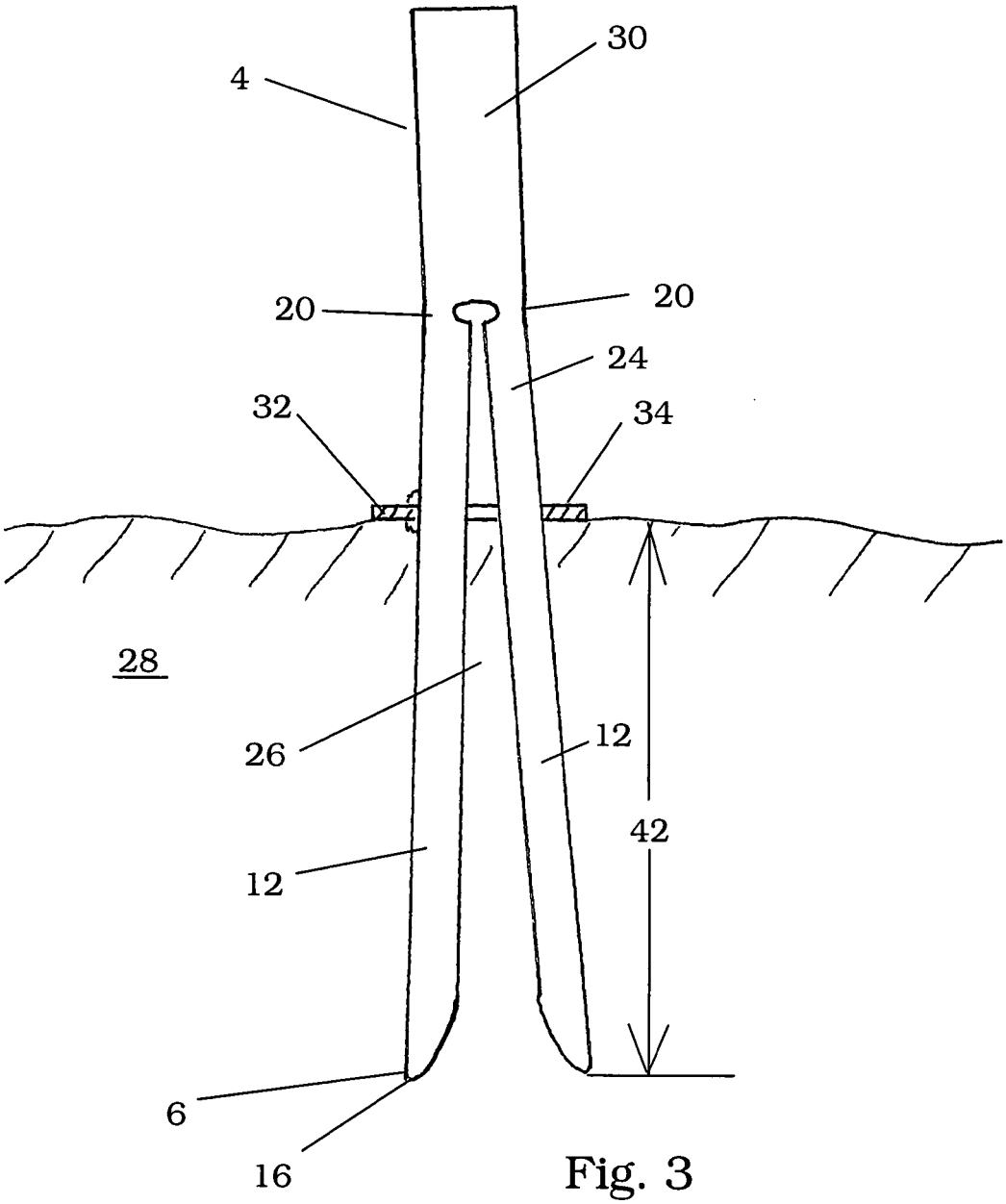
FIG. 3 is a side view of the anchor body and cantilever beams in the second position.

FIGS. 1, 2 and 3 illustrate the principle of operation of the impact sand anchor 2. The impact sand anchor 2 has an anchor body 4. The anchor body 4 defines an anchor bottom end 6, an anchor top end 8 and an anchor longitudinal axis 10 between anchor bottom end 6 and anchor top end 8.

A plurality of cantilever beams 12 may be defined by the body 4. The drawings illustrate two cantilever beams 12, which has proven suitable in practice; however, any number of cantilever beams 12 greater than one is contemplated by the Invention. Each of the cantilever beams 12 has a cantilever top end 14, a cantilever bottom end 16 and an elongated dimension 18 between the cantilever top end 14 and the cantilever bottom end 16. The plurality of cantilever beams 12 each has a pivot location 20 and can move between a first position (FIG. 2) and a second position (FIG. 3). The pivot location 20 is effectively a flat spring urging the cantilever beams 12 into the first position.

Figure 11:
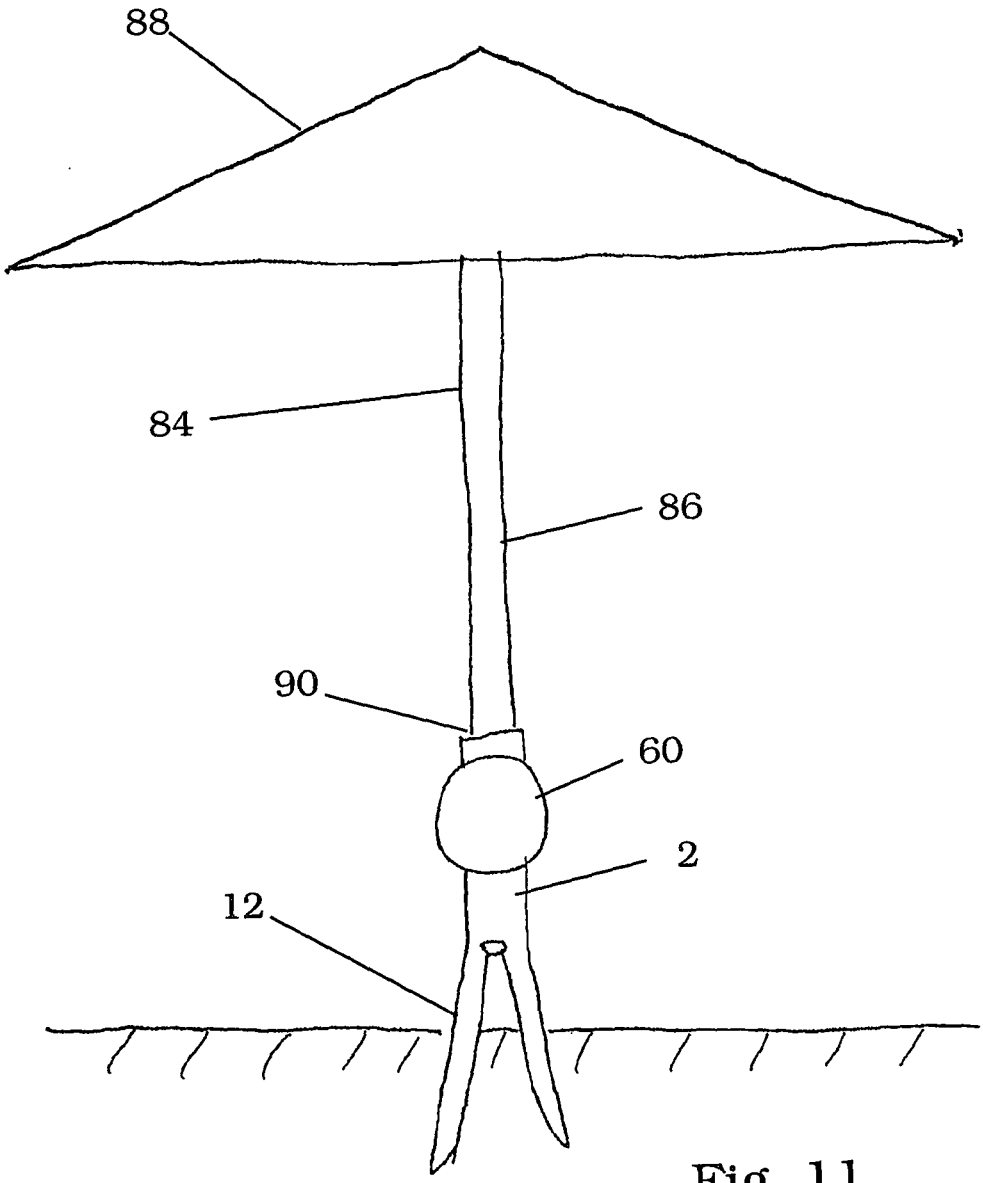
FIG. 11 is a side view of an integrated impact sand anchor and an umbrella.

The first position, as illustrated by FIGS. 1, 2, 4, 7 and 8 corresponds to the sand anchor 2 not in engagement with sand 28, as during transportation or storage of the sand anchor 2. The second position, also as illustrated by FIGS. 3, 9 and 11, corresponds to the sand anchor 2 in use and anchored to sand 28. In operation, the anchor bottom end 6, defined by the cantilever bottom ends 16, is placed in contact with the sand 28 and the sand anchor 2 is driven in the downward direction 58 (FIG. 4), as by a circular hammer 50. The act of driving the cantilever beams 12 into the sand 28 packs sand 28 into the interior volume 26 defined by the cantilever beams 12. The packed sand 26 applies a force on the inner side 48 (see FIGS. 7 and 9) of the cantilever beams 12, forcing the cantilever bottom ends 16 to move radially away from the longitudinal axis 10 of the body 4. The spreading of the cantilever bottom ends 16 wedges the cantilever beams 12 into the sand 26, providing enhanced resistant to pull-out loads (force applied along the longitudinal axis 10 away from the ground) and pullover loads (loads applied parallel to the surface of the ground but spaced apart from the sand anchor 2, as by a wind blowing on a beach umbrella 84 supported by the and anchor 2).

The improved strength of the connection of the sand anchor 2 to the sand 26 allows the sand anchor 2 to be driven to an insertion depth 42 that is shallower than otherwise would be the case and to nonetheless adequately anchor the beach umbrella 84 or other object to the sand 26. An insertion depth 42 of nine inches has proven suitable in practice.

Figure 4:
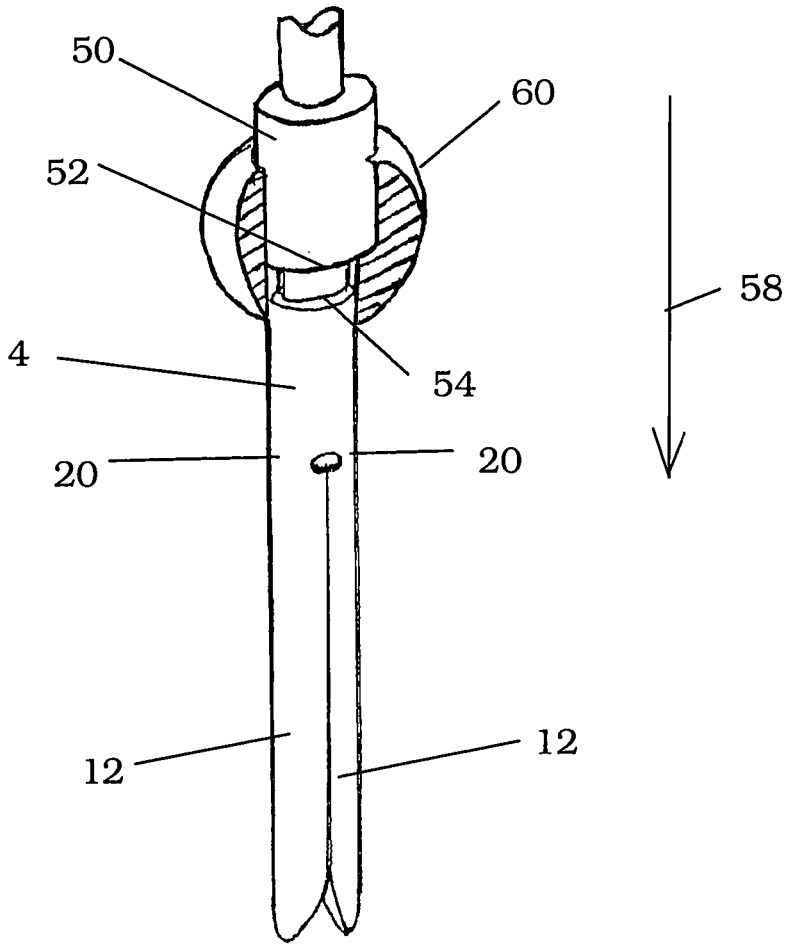
FIG. 4 is perspective partial cutaway view of the impact sand anchor.
Figure 5:
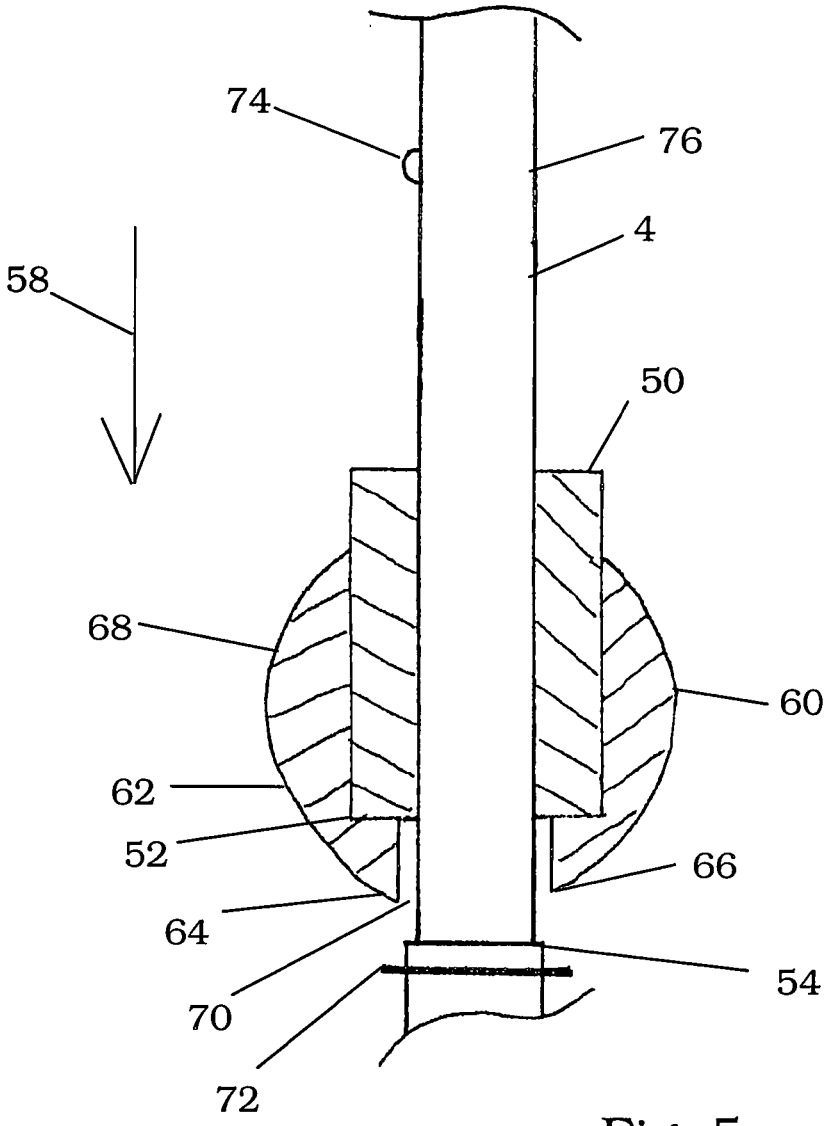
FIG. 5 is a cross section of the anchor body and cylindrical hammer.

FIGS. 4 and 5 illustrate the operation of the cylindrical hammer 50 and guard 60. FIG. 4 is a perspective partial cutaway view. FIG. 5 is a sectional side view. From FIGS. 4 and 5, the cylindrical hammer 50 encircles the anchor body 4 and is configured to slide on the anchor body 4 in the direction of the anchor longitudinal axis 10. Where the impact sand anchor 2 is attached to a shaft 86 of a beach umbrella 84, the cylindrical hammer 50 may encircle the shaft 86 and may be configured to slide in the direction of the longitudinal axis 10 on the shaft 84.

From FIG. 5, a lower stop 54 defines a limit of travel of the cylindrical hammer 50 in the downward direction 58. When the cylindrical hammer 50 is traveling in the downward direction 58 and strikes the lower stop 54, the momentum of the cylindrical hammer 50 is transferred to the body 4 and hence to the cantilever beams 12, driving the cantilever bottom ends 16 into the sand 28.

To avoid pinch injury to the hand of the user and as shown by FIG. 5, a guard 60 encircles the cylindrical hammer 50 and extends in the downward direction 58 beyond the bottom end 52 of the cylindrical hammer 50. The guard 60 is composed of a resilient material 62, such as natural rubber, foam or a resilient polymer. Should the user inadvertently place the user's hand on the lower stop 54 during use of the cylindrical hammer 50, the guard bottom end 64 will push the user's hand out of the way of the bottom end 52 of the cylindrical hammer 50 before the bottom end 52 of the hammer 60 strikes the lower stop 54, avoiding injury. A generally spherical guard 60 has proven suitable in practice and serves as a grip by which the user may hold and operate the cylindrical hammer 50. The guard 60 allows the user to maintain his or her grip on the cylindrical hammer 50 when the cylindrical hammer 50 impacts the lower stop 54, which serves to transfer the momentum of the user's arm to the cylindrical hammer 50 and hence to the lower stop 54, body 4 and cantilever beams 12. Transfer of the momentum of the user's arm to the cylindrical hammer 50 by use of the guard 60 allows use of a lighter cylindrical hammer 50 than would otherwise be the case.

A hole is defined by the spherical guard 60 to allow the guard 60 to encircle and engage the cylindrical hammer 50 and to clear the lower stop 54. The shape of the bottom end 64 of the guard 60 is defined by the guard 60 and the hole penetrating the guard 60. The shape of the bottom end of the guard 60 may approximate a torroid having a generally triangular cross section. When the bottom end of the guard 64 strikes the hand of a user, a small cross sectional area of the resilient material 62 from which the guard 60 is composed first engages the hand. As the resilient material 62 compresses as a result of the collision, the cross sectional area of the resilient material engaging the hand increases, with the cross-sectional area of the resilient material engaging the hand increasing as the collision progresses. Because the force exerted by the guard 60 on the user's hand is proportional to the cross sectional area of the resilient material acting upon the hand, the force applied to the user's hand by the cylindrical hammer 50 increases progressively until the hand is pushed out of the way of the hammer 50. The user's hand does not experience the impact of the cylindrical hammer 50 on the lower stop 54.

Any other shape of the guard 60 and its bottom end 64 is contemplated by the invention.

From FIG. 5, the fact that the guard 60 surrounds the body 4 below the lower stop 54 when the hammer bottom end 52 impacts the lower stop 54 serves to attenuate airborne noise from the impact. A seal 72 may further attenuate noise. The seal encircles the body 4 immediately below the lower stop 54 in the downward direction 58. The guard bottom end 64 engages the seal 72 prior to the impact between the cylindrical hammer bottom end 52 and the lower stop 54, partially blocking airborne noise from the impact.

From FIG. 5, an upper stop 74 may limit the range of travel of the cylindrical hammer 50 in the upward direction. The upper stop 74 may be a pin, screw, ring, change in body 4 diameter, or any other suitable feature to block movement of the cylindrical hammer 50 beyond the desired limit of travel in the upward direction.

Figure 6:
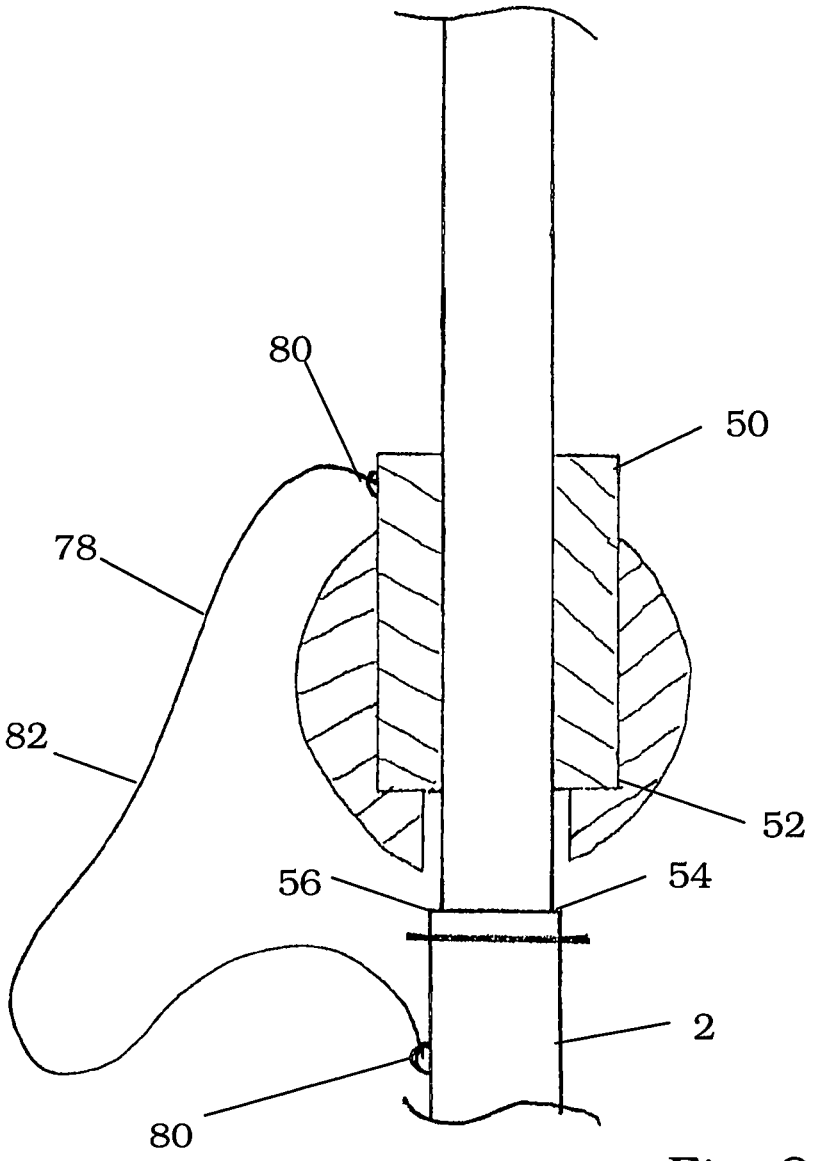
FIG. 6 is a cross section of the anchor body and cylindrical hammer with a cord defining an upper stop.

From FIG. 6, the range of travel of the cylindrical hammer 50 in the upward direction may be limited by a cord 78. The cord 78 has two ends 80. One of the ends 80 is attached to the cylindrical hammer 50 and the other is attached to the body 4 below the lower stop 54. The length 82 of the cord 78 is selected to allow the cylindrical hammer 50 to drive the cantilever beams 12 into the sand 28, but not so long as to allow the cylindrical hammer 50 to escape.

Figure 7:
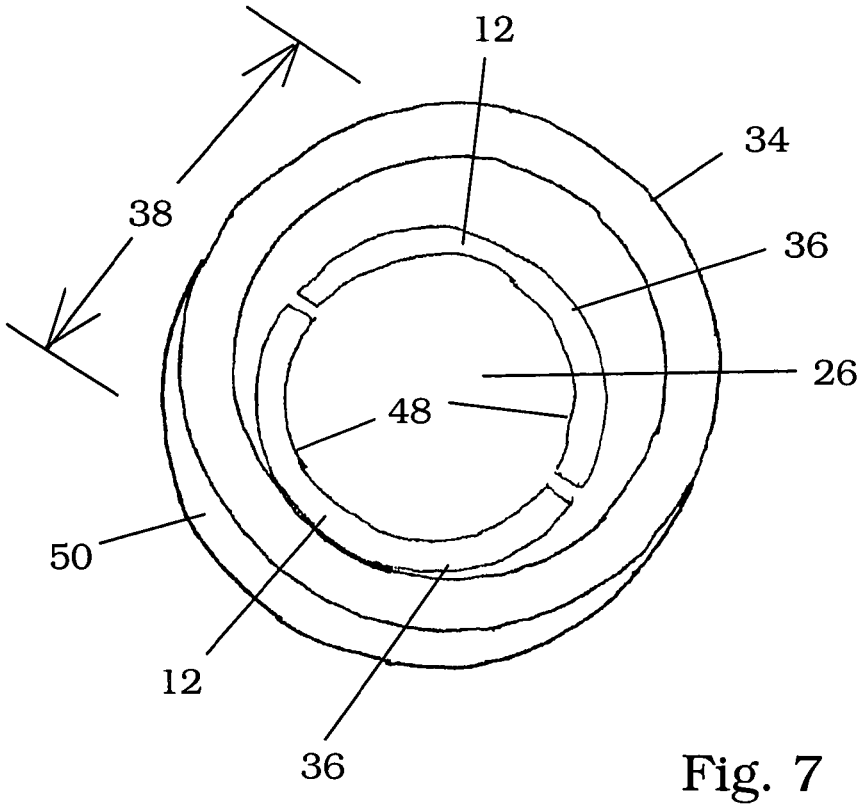
FIG. 7 is an end view of the cantilever beams and ring limiter with the cantilever beams in the first position.

FIG. 7 is an end view from the bottom end 6 of the body 4 with the cantilever beams 12 in the first position. As shown by FIG. 7, the cantilever beams 12 may be arcuate in cross section, which provides strength in flexure to the cantilever beams 12. Any other suitable cross sectional shape for the cantilever beams 12 may be used, such as 'U' shaped, triangular, rectangular, an 'I' beam shape, or any other shape having adequate stiffness and strength in flexure to allow the cantilever beam 12 to move from the first to the second position without failure and in response to force exerted by the sand 28 as the bottom end 16 of body 6 is driven into the sand 28. A ready way to achieve the arcuate cross section for the cantilever beams 12 is to cut the body 4 and cantilever beams 12 from a single piece of a hollow cylinder, such as a steel tube, but any other means to form the body and to form the cantilever beams may be used, such as molding, casting or welding.

FIGS. 2, 3 and 7 illustrate a limiter 32 in the form of a ring 34. As shown by FIGS. 2, 3 and 7, the ring 34 encircles the outer sides 36 of the cantilever beams 12. The ring 34 is attached to the outer side 36 of one of the cantilever beams 12, as by welding, part way between the cantilever bottom end 16 and the pivot location 20. The ring 34 is not attached to the outer sides 36 of the other cantilever beam(s) 12. The ring 34 has an inside diameter 38 that corresponds to the location of the outer sides 36 of the cantilever beams 12 when the cantilever beams 12 are in the second position, as shown by FIG. 3. The ring 34 limits the radial spread of the cantilever beams 12 when the cantilever beams 12 are driven into the sand and hence defines the second position of the cantilever beams 12. The ring 34 prevent excess deformation and hence failure of the pivot locations 20.

As shown by FIG. 3, the ring 34 can also serve as a gauge and stop to control the insertion depth 42 of the cantilever beams 12 into the sand 28. The location of the ring 34 with respect to the sand 28 visually informs the user as to the insertion depth 42 of the cantilever beams 12 with respect to the sand. The resistance to downward motion of the cantilever beams 12 also will increase substantially when the ring 34 reaches the sand 28, further informing the user that the appropriate insertion depth 42 is reached.

Figure 8:
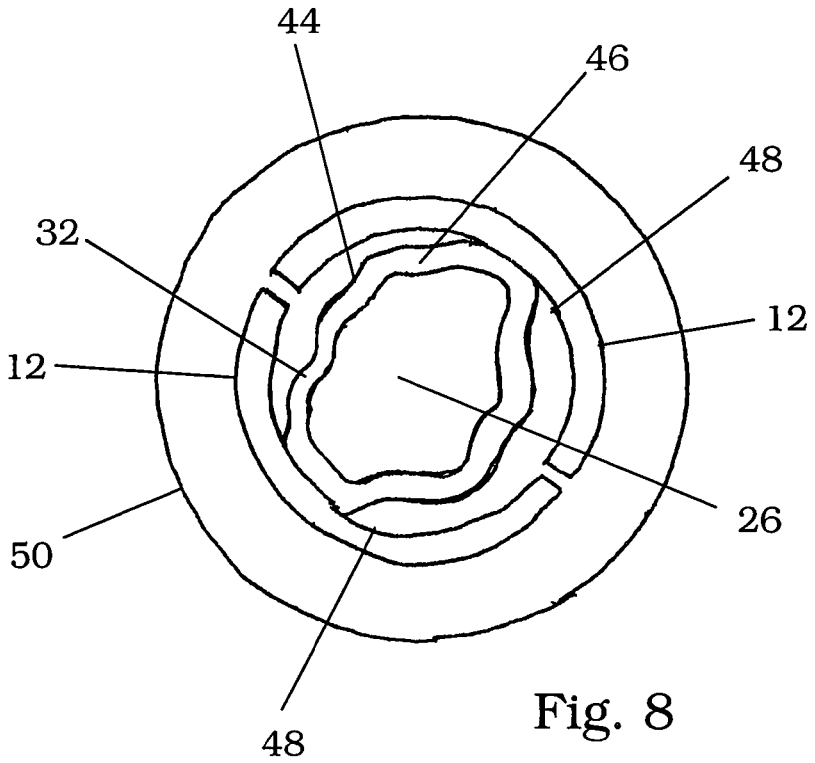
FIG. 8 is an end view of the cantilever beams and cable limiter with the cantilever beams in the first position.
Figure 9:
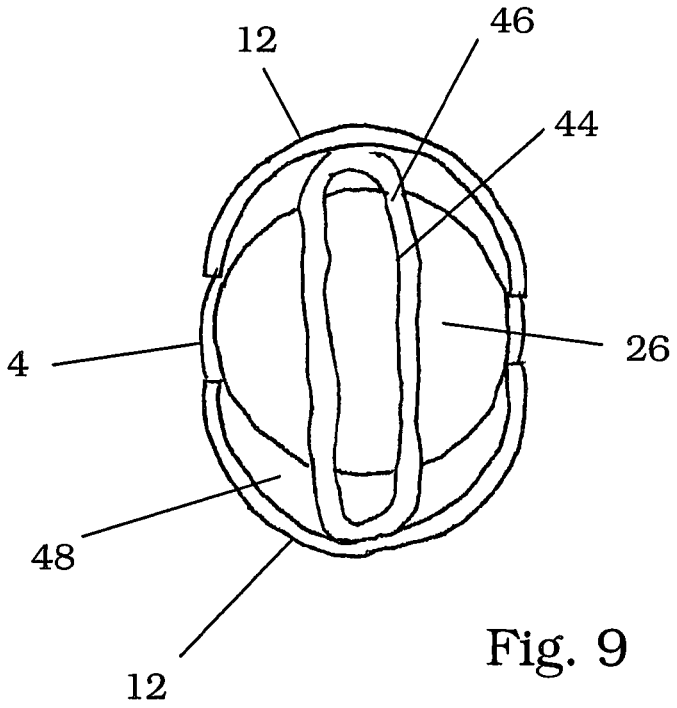
FIG. 9 is an end view of the cantilever beams and cable limiter with the cantilever beams in the second position.

FIGS. 8 and 9 are both end views from the bottom end 16 of the body 4. FIGS. 8 and 9 illustrate a second limiter 32 in the form of a loop 46 of a flexible cable 44. FIG. 8 shows the cantilever beams 12 in the first position. The flexible cable 44 is attached to the inner sides 48 of each of the cantilever beams 12. The flexible cable 44 has adequate length to allow the cantilever beams 12 to move to the second position, but the flexible cable 46 is not so long as to allow the cantilever beams 12 to excessively deform the pivot location 20. Alternatively, the flexible cable 44 may encircle the outer sides 36 of the cantilever beams 12, as does the ring 34.

FIG. 9 shows the flexible cable 44 of FIG. 8 when the cantilever beams 12 are in the second position. The loop 46 of cable 44 is stretched between the inner sides 48 of the cantilever beams 12, defining the second position of the cantilever beams 12 and limiting the radial motion of the cantilever beams 12. The loop 46 also serves as a stop to the downward movement of the cantilever beams 12 during installation of the cantilever beams 12 in the sand 28. When the sand 28 packed into the interior volume 26 reaches the loop 46, the downward movement of the cantilever beams 12 is slowed substantially by the force applied to the loop 46 by the sand 28, informing the user that the appropriate insertion depth 42 is reached.

Figure 10:
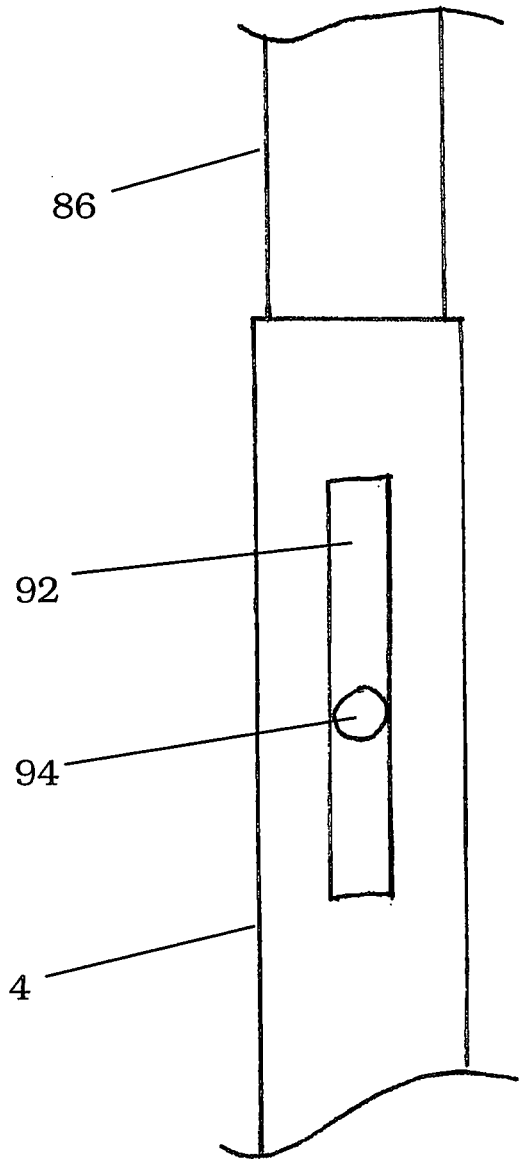
FIG. 10 is a side view of the slot and pin connection of the anchor body and a shaft.

FIG. 10 illustrates a pin connection between the body 4 of the impact sand anchor 2 and a shaft 86 of an umbrella 84. The connection of FIG. 10 also applies to any other desired connection of the impact sand anchor 2 and any other object to be supported. As shown by FIG. 10, the body 4 defines a slot 92. The shaft 86 features a pin 94. The pin 94 penetrates the slot 92. The pin 94 has a fixed position with respect to the shaft 86.

The pin 94 may be releasable, as in a spring-loaded button. If the pin 94 is releasable, then the shaft 86 and hence the umbrella 84 may be separated from the impact sand anchor 2.

The slot 92 also assists in installation of the combination of the umbrella 84 and impact sand anchor 2 into the sand 28 when the umbrella 84 and the impact sand anchor 2 are attached. The slot 92 extends below the pin 94 in the downward direction 58 when the shaft 86 and the body 4 are engaged. When the user places the cantilever beams 12 in contact with the sand 28 and operates the cylindrical hammer 12, the pin 94 does not engage the end of the slot 92 and does not impart force from the hammer 50 to the shaft 86 and hence to the remainder of the umbrella 84. The mass of the shaft 86 and canopy 88 of the umbrella 84 therefore does not resist the acceleration imparted to the body 2 by the cylindrical hammer 50. In response to a blow from the cylindrical hammer 50, the impact sand anchor 2 moves in a downward direction 58 below the shaft 86 and umbrella 84. The shaft 86 and umbrella 84 then fall by the force of gravity for a short distance and catch up to the now-stationary impact sand anchor 2. The collision between the falling shaft 86 and umbrella 84 and the stationary impact sand anchor 2 drives the impact sand anchor 2 deeper into the sand 28.

From FIG. 11, the Invention is also an integrated umbrella 84 and an impact sand anchor 2. The integrated umbrella 84 and impact sand anchor 2 operate in the manner discussed above. Alternatively, the impact sand anchor 2 may be standalone and may provide an appropriate receptacle for insertion of the shaft 86 of the umbrella 84 or other object to be supported by the impact sand anchor 2.

Figure 12:
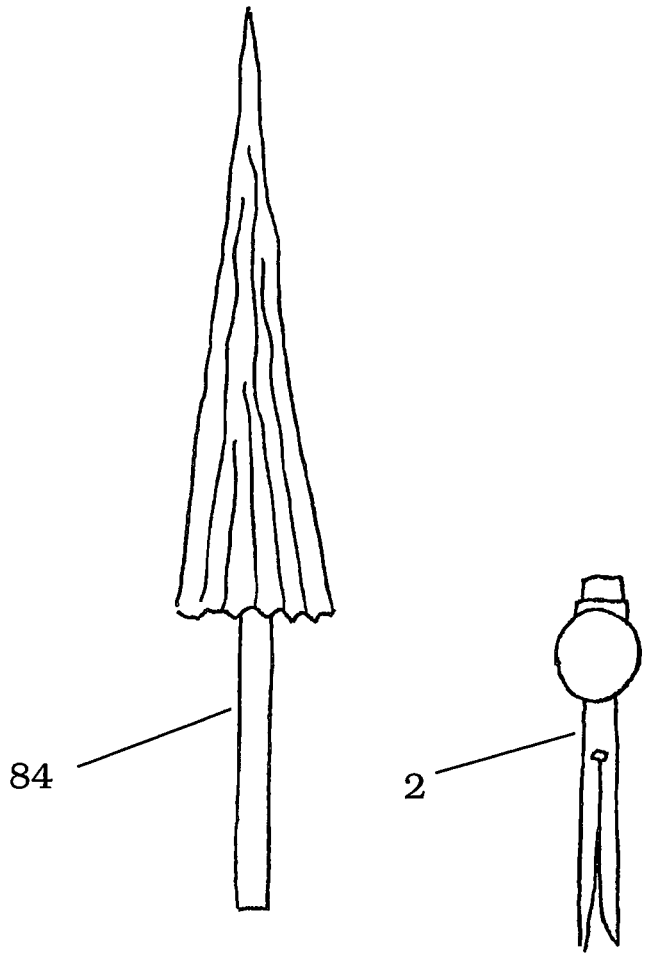
FIG. 12 illustrates the components of a kit comprising an umbrella and the impact sand anchor.

From FIG. 12, the Invention also is a kit of parts comprising an umbrella 84 and an impact sand anchor 2.

The Invention is also a method of supporting an object, such as an umbrella 84 using the impact sand anchor 2. In the method of the invention, the first step is to place the cantilever bottom end 16 of the cantilever beams 16 in contact with the sand 28. The second step is to alternately slide the cylindrical hammer 50 up and down the body 4, impacting the cylindrical hammer 50 against the lower stop 54 and driving the cantilever beams 12 into the sand 28. The cantilever beams 12 will move to the second position, as described above, anchoring the impact sand anchor 2 to the sand 28. If the shaft 86 of the umbrella 84 or other object to be supported is in engagement with the body 4, then the installation is complete. If the shaft 86 of the umbrella 84 or other object to be supported is not already in engagement with the body 4, the third and final step is to place the shaft 86 in engagement with the body 4, completing the installation.

The inventors have performed comparison testing of the impact sand anchor 2 of the Invention to other available sand anchors and to a bare pole to determine the strength of the connection of the sand anchors and bare pole to the sand. For each test, the sand anchor or pole was installed in the sand per manufacturer's direction and embedded to the depth indicated below. A force gauge was attached to the sand anchor to be tested. For the pullout test, the force required to pull the sand anchor or pole from the sand 28 along the longitudinal axis of the pole was measured. For the pullover test, the force required to cause the shaft attached to the sand anchor to tilt at an angle of 45 degrees was measured, where the force was applied to a shaft four feet above the surface of the sand 28 and in a direction parallel to the surface of the sand 28. All tests were performed in moist sand below the high tide mark on a beach.

In the following table, the 'impact sand anchor' is the impact sand anchor described in this document. The 'tapered thread anchor' is generally in the shape of a narrow cone having threads on the cone. The 'auger-type anchor' comprises a tube having a propeller-shaped auger at its bottom end. The results are as follows:

Pullout Force (Force Along the Longitudinal Axis)

1. Impact sand anchor 2 (9 in. vertical embedment)—44 lb before pullout
2. Tapered thread anchor (11 in. vertical embedment, per manufacturer directions)—pullout force exceeded the 50 lb. capacity of the test equipment.
3. Auger-type anchor having four-inch diameter blade (9 in. vertical embedment)—39 lb before pullout.
4. Bare pole (12 in. vertical embedment)—5 lb before pullout.

Pullover Force (Force Applied Parallel to the Ground Surface Four Feet Above the Ground Surface Required to Apply a 45 Degree Tilt to the Shaft).

1. Impact sand anchor of the Invention: 18 lb. pullover force
2. Tapered thread anchor: 10 lb. pullover force
3. Auger-type anchor: 18 lb. pullover force
4. bare pole: 12 lb. pullover force From the foregoing, the tapered threaded anchor performed well against pullout, but was weak against pullover, weaker than even the bare pole. The bare pole provided very little resistance to pullout, but was better resisting pullover. The impact sand anchor 2 of the Invention and the auger-type sand anchor both performed well under both pullout and pullover loads; however, the impact sand anchor 2 of the Invention was much faster and easier to install than the auger-type sand anchor.

During the testing the tapered thread anchor and the auger-type anchor both required substantial upper-body strength to install, and required an average of 40 seconds to embed the sand anchors to the prescribed depth. The impact sand anchor 2 of the invention required an average of 15 seconds to install, with much less upper body strength required.

LIST OF NUMBERED ELEMENTS

2 a impact sand anchor
4 an anchor body
6 an anchor bottom end
8 an anchor top end
10 an anchor longitudinal axis
12 a plurality of cantilever beams
14 a cantilever top end
16 a cantilever bottom end
18 an elongated dimension
20 a pivot location
22 a first position
24 a second position
26 an interior volume
28 a sand
30 a hollow cylinder (body)
32 a limiter
34 a ring
36 an outer side
38 an inside diameter
40 a location along said longitudinal axis,
42 an insertion depth
44 a cable
46 a loop
48 an inside surface
50 a cylindrical hammer
52 a hammer bottom end
54 a lower stop
56 a limit of travel

58 a downward direction
60 a guard
62 a resilient material
64 a guard bottom end
66 a torroid having a generally triangular cross section
68 a sphere
70 a cylindrical opening
72 a seal
74 an upper stop
76 a limit of travel of said cylindrical hammer in an upward direction
78 a cord
80 two ends
82 a length
84 a beach umbrella
86 a shaft
88 a canopy
90 an attachment to said body
92 a slot
94 a pin

We claim:

1. An impact sand anchor, the impact sand anchor comprising:

a. an anchor body, said anchor body being in a shape of a hollow cylinder, said anchor body defining an anchor bottom end, an anchor top end and an anchor longitudinal axis between said anchor top end and said anchor bottom end;

b. a plurality of cantilever beams defined by said hollow cylinder, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. a second position of said cantilever beams, each of said cantilever beams being elastically movable to said second position when said anchor bottom end is placed in contact with a sand and is driven to an insertion depth, said insertion depth being less than said elongated dimension of said cantilever beams, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom end and said cantilever beam top end;

f. a limiter, said limiter being configured to prevent a movement of said plurality of cantilever beams in said radial direction beyond said second position, said limiter comprising: a ring, each of said cantilever beams having an outer side, said ring encircling said outer side of said plurality of cantilever beams, said ring having an inside diameter, said inside diameter defining said second position of said cantilever beams, said ring being fixedly attached to said outer side of a one of said plurality of cantilever beams, said ring not being fixedly attached to each other of said plurality of cantilever beams, whereby when said anchor bottom end is placed in contact with said sand and said anchor bottom end is driven into said sand, said sand enters said interior volume and applies a force to said inner side of each said cantilever beam and said force urges each said cantilever beam to move elastically and not plastically to said second position, and whereby when said anchor bottom end is removed from said sand and said sand is removed from said interior volume each said cantilever beam resiliently returns to said first position.

2. The impact sand anchor of claim 1 wherein said ring has a location along said longitudinal axis, said location corresponding to said insertion depth of said anchor bottom end into said sand when said cantilever beams are in said second position, whereby said ring resists penetration of said anchor bottom end beyond said insertion depth.

3. An impact sand anchor, the impact sand anchor comprising:

a. an anchor body, said anchor body defining an anchor bottom end, an anchor top end and an anchor longitudinal axis between said anchor top end and said anchor bottom end;

b. a plurality of cantilever beams defined by said anchor body, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. each said cantilever beam being elastically movable to a second position, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom ends and said cantilever beam top ends, whereby when said anchor bottom end is placed in contact with a sand and said anchor bottom end is driven into said sand, said sand enters said interior volume and applies a force to said inner side of each said cantilever beam and said force urges said cantilever beam to said second position and whereby when said sand anchor bottom end is removed from said sand and said sand is removed from said interior volume each said cantilever beam resiliently returns to said first position;

f. a limiter, said limiter being configured to limit a movement of said plurality of cantilever beams in said second position wherein said limiter comprises: a cable, said cable being flexible, said cable defining a loop, said loop of said cable being attached to at least one of said cantilever beams.

4. The impact sand anchor of claim 3 wherein each said cantilever beams defines an inside surface and wherein said loop of said cable is attached to said inside surface of each of said cantilever beams at a location along said longitudinal axis, said location corresponding to an insertion depth of said plurality of cantilever beams into said sand when said cantilever beams are in said second position.

5. An impact sand anchor, the impact sand anchor comprising:

a. an anchor body, said anchor body being in a shape of a hollow cylinder, said anchor body defining an anchor bottom end, an anchor top end and an anchor longitudinal axis between said anchor top end and said anchor bottom end;

b. a plurality of cantilever beams defined by said hollow cylinder, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. a second position of said cantilever beams, each of said cantilever beams being elastically movable to said second position when said anchor bottom end is placed in contact with a sand and is driven to an insertion depth, said insertion depth being less than said elongated dimension of said cantilever beams, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom end and said cantilever beam top end, whereby when said anchor bottom end is placed in contact with said sand and said anchor bottom end is driven into said sand, said sand enters said interior volume and applies a force to said inner side of each said cantilever beam and said force urges each said cantilever beam to elastically move to said second position, and whereby when said anchor bottom end is removed from said sand and said sand is removed from said interior volume each said cantilever beam resiliently returns to said first position;

f. a cylindrical hammer, said cylindrical hammer encircling said body and being configured to move along said longitudinal axis, said cylindrical hammer defining a hammer bottom end;

g. a lower stop, said lower stop being disposed on said body, said lower stop defining a limit of travel of said cylindrical hammer in a direction toward said cantilever bottom ends of said plurality of cantilever beams, whereby said cylindrical hammer is configured to move in a downward direction and to impact said lower stop and thereby to drive said cantilever beams into said sand;

h. a guard, said guard being attached to said cylindrical hammer and composed of a resilient material, said guard encircling said hammer bottom end and extending beyond said hammer bottom end in said downward direction, said guard extending beyond said lower stop when said hammer bottom end is in engagement with said lower stop, whereby said guard is configured to push a hand of a user away from said lower stop when said hammer bottom end moves into engagement with said lower stop and to thereby avoid a pinch injury to said user.

6. An impact sand anchor, the impact sand anchor comprising:

a. an anchor body, said anchor body defining an anchor bottom end, an anchor top end and an anchor longitudinal axis between said anchor top end and said anchor bottom end;

b. a plurality of cantilever beams defined by said anchor body, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. each said cantilever beam being elastically movable to a second position, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom ends and said cantilever beam top ends, whereby when said anchor bottom end is placed in contact with a sand and said anchor bottom end is driven into said sand, said sand enters said interior volume and applies a force to said inner side of each said cantilever beam and said force urges said cantilever beam to said second position and whereby when said sand anchor bottom end is removed from said sand and said sand is removed from said interior volume each said cantilever beam resiliently returns to said first position;

f. a cylindrical hammer, said cylindrical hammer encircling said body and being configured to move along said longitudinal axis, said cylindrical hammer defining a hammer bottom end;

g. a lower stop, said lower stop being disposed on said body, said lower stop defining a limit of travel of said cylindrical hammer in a direction toward said cantilever bottom ends of said plurality of cantilever beams, whereby said cylindrical hammer is configured to move in a downward direction and to impact said lower stop and thereby to drive said cantilever beams into said sand;

h. a guard, said guard being attached to said cylindrical hammer and composed of a resilient material, said guard encircling said hammer bottom end and extending beyond said hammer bottom end in said downward direction, said guard extending beyond said lower stop when said hammer bottom end is in engagement with said lower stop, said bottom end being generally in the shape of a torroid having a generally triangular cross section, whereby if said guard contacts a hand of a user when said hammer bottom end moves into engagement with said lower stop, a small cross-section area of said resilient material contacts said hand, allowing said resilient material to deform and preventing a pinch injury to said user.

7. An impact sand anchor, the impact sand anchor comprising:

a. an anchor body, said anchor body defining an anchor bottom end, an anchor top end and an anchor longitudinal axis between said anchor top end and said anchor bottom end;

b. a plurality of cantilever beams defined by said anchor body, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. each said cantilever beam being elastically movable to a second position, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom ends and said cantilever beam top ends, whereby when said anchor bottom end is placed in contact with a sand and said anchor bottom end is driven into said sand, said sand enters said interior volume and applies a force to said inner side of each said cantilever beam and said force urges said cantilever beam to said second position and whereby when said sand anchor bottom end is removed from said sand and said sand is removed from said interior volume each said cantilever beam resiliently returns to said first position;

f. a cylindrical hammer, said cylindrical hammer encircling said body and being configured to move along said longitudinal axis, said cylindrical hammer defining a hammer bottom end;

g. a lower stop, said lower stop being disposed on said body, said lower stop defining a limit of travel of said cylindrical hammer in a direction toward said cantilever bottom ends of said plurality of cantilever beams, whereby said cylindrical hammer is configured to move in a downward direction and to impact said lower stop and thereby to drive said cantilever beams into said sand;

h. a guard, said guard being attached to said cylindrical hammer and composed of a resilient material, said guard encircling said hammer bottom end and extending beyond said hammer bottom end in said downward direction, said guard extending beyond said lower stop when said hammer bottom end is in engagement with said lower stop wherein said guard is in the shape of a sphere having a cylindrical opening to receive said cylindrical hammer.

8. An impact sand anchor, the impact sand anchor comprising:

a. an anchor body, said anchor body defining an anchor bottom end, an anchor top end and an anchor longitudinal axis between said anchor top end and said anchor bottom end;

b. a plurality of cantilever beams defined by said anchor body, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. each said cantilever beam being elastically movable to a second position, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom ends and said cantilever beam top ends, whereby when said anchor bottom end is placed in contact with a sand and said anchor bottom end is driven into said sand, said sand enters said interior volume and applies a force to said inner side of each said cantilever beam and said force urges said cantilever beam to said second position and whereby when said sand anchor bottom end is removed from said sand and said sand is removed from said interior volume each said cantilever beam resiliently returns to said first position;

f. a cylindrical hammer, said cylindrical hammer encircling said body and being configured to move along said longitudinal axis, said cylindrical hammer defining a hammer bottom end;

g. a lower stop, said lower stop being disposed on said body, said lower stop defining a limit of travel of said cylindrical hammer in a direction toward said cantilever bottom ends of said plurality of cantilever beams, whereby said cylindrical hammer is configured to move in a downward direction and to impact said lower stop and thereby to drive said cantilever beams into said sand;

h. a guard, said guard being attached to said cylindrical hammer and composed of a resilient material, said guard encircling said hammer bottom end and extending beyond said hammer bottom end in said downward direction, said guard extending beyond said lower stop when said hammer bottom end is in engagement with said lower stop;

i. a seal, said seal being disposed on and encircling said body proximal to said lower stop, said seal being configured so that said guard contacts said seal prior to said cylindrical hammer contacting said lower stop when said cylindrical hammer is moving in said downward direction, whereby said guard and said seal in combination attenuate transmission of sound through the air from a contact by said bottom side of said cylindrical hammer and said lower stop.

9. An impact sand anchor, the impact sand anchor comprising:

a. an anchor body, said anchor body being in a shape of a hollow cylinder, said anchor body defining an anchor bottom end, an anchor top end and an anchor longitudinal axis between said anchor top end and said anchor bottom end;

b. a plurality of cantilever beams defined by said hollow cylinder, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. a second position of said cantilever beams, each of said cantilever beams being elastically movable to said second position when said anchor bottom end is placed in contact with a sand and is driven to an insertion depth, said insertion depth being less than said elongated dimension of said cantilever beams, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom end and said cantilever beam top end, whereby when said anchor bottom end is placed in contact with said sand and said anchor bottom end is driven into said sand, said sand enters said interior volume and applies a force to said inner side of each said cantilever beam and said force urges each said cantilever beam to elastically move to said second position, and whereby when said anchor bottom end is removed from said sand and said sand is removed from said interior volume each said cantilever beam resiliently returns to said first position;

f. a cylindrical hammer, said cylindrical hammer encircling said body and being configured to move along said longitudinal axis, said cylindrical hammer defining a hammer bottom end;

g. a lower stop, said lower stop being disposed on said body, said lower stop defining a limit of travel of said cylindrical hammer in a direction toward said cantilever bottom ends of said plurality of cantilever beams, whereby said cylindrical hammer is configured to move in a downward direction and to impact said lower stop and thereby to drive said cantilever beams into said sand;

h. an upper stop, said upper stop defining a limit of travel of said cylindrical hammer in an upward direction.

10. An impact sand anchor, the impact sand anchor comprising:

a. an anchor body, said anchor body defining an anchor bottom end, an anchor top end and an anchor longitudinal axis between said anchor top end and said anchor bottom end;

b. a plurality of cantilever beams defined by said anchor body, each of said cantilever beams defining a cantilever top end, a cantilever bottom end and an elongated dimension between said cantilever top end and said cantilever bottom end, said cantilever bottom ends in combination defining said anchor bottom end;

c. each of said cantilever beams having a first position, said elongated dimension of each of said cantilever beams being generally parallel to said anchor longitudinal axis when said cantilever beams are in said first position, each said cantilever beam being elastically urged to said first position;

d. each said cantilever beam being elastically movable to a second position, said bottom ends of said cantilever beams being displaced outward in a radial direction about said longitudinal axis when said cantilever beams are in said second position;

e. an interior volume defined by said plurality of cantilever beams in cooperation, said interior volume being disposed along said anchor longitudinal axis between said cantilever beam bottom ends and said cantilever beam top ends, whereby when said anchor bottom end is placed in contact with a sand and said anchor bottom end is driven into said sand, said sand enters said interior volume and applies a force to said inner side of each said cantilever beam and said force urges said cantilever beam to said second position and whereby when said sand anchor bottom end is removed from said sand and said sand is removed from said interior volume each said cantilever beam resiliently returns to said first position;

f. a cylindrical hammer, said cylindrical hammer encircling said body and being configured to move along said longitudinal axis, said cylindrical hammer defining a hammer bottom end;

g. a lower stop, said lower stop being disposed on said body, said lower stop defining a limit of travel of said cylindrical hammer in a direction toward said cantilever bottom ends of said plurality of cantilever beams, whereby said cylindrical hammer is configured to move in a downward direction and to impact said lower stop and thereby to drive said cantilever beams into said sand;

h. an upper stop, said upper stop defining a limit of travel of said cylindrical hammer in an upward direction wherein said upper stop comprises: a cord, said cord having two ends and a length, a one of said ends being attached to said cylindrical hammer, another of said ends being attached to said body, said length being selected to define said limit of travel of said cylindrical hammer in said upward direction.

* * * * *